United States Patent [19]

Fischer

[11] Patent Number: 4,735,064

[45] Date of Patent: Apr. 5, 1988

[54] ENERGY STORAGE CONTAINER AND SYSTEM

[76] Inventor: Harry C. Fischer, P.O. Box 445, Maggie Valley, N.C. 28751

[21] Appl. No.: 931,258

[22] Filed: Nov. 17, 1986

[51] Int. Cl.[4] ..... F25D 11/00

[52] U.S. Cl. ..... 62/430; 62/307

[58] Field of Search ..... 237/2 B; 62/199, 238.6, 62/430, 307, 324.1, 59; 165/18

[56] References Cited

U.S. PATENT DOCUMENTS

| | | | |
|---|---|---|---|
| 4,096,709 | 6/1978 | Barthel | 62/430 |
| 4,294,078 | 10/1981 | MacCracken | 62/430 |
| 4,637,219 | 1/1987 | Grose | 62/430 |

*Primary Examiner*—Henry A. Bennet

*Attorney, Agent, or Firm*—David M. Carter

[57] ABSTRACT

There is provided an improved energy storage system which includes a tank for holding water or eutectic material and housing a plurality of coils. The coils are connected to a condensing unit and to an evaporating unit which is positioned in the space to be temperature conditioned. The condensing unit supplies refrigerant to the coils for solidifying the material in the container during a first time period, thus storing energy. During a second time period, the coils in the tank supply refrigerant to the evaporating unit while the condensing unit is not in use. The condensing unit may also supply refrigerant directly to the evaporating unit without substantially reducing the energy already stored in the container during a third time period.

9 Claims, 1 Drawing Sheet

ENERGY STORAGE CONTAINER AND SYSTEM

BACKGROUND OF THE INVENTION

This invention relates to energy storage systems. More particularly, it relates to methods and apparatuses for storing ice or eutectic material for efficiently and inexpensively supplying stored energy during peak electrical demand times.

In recent years, electric utilities have been pricing electricity using a two-tier system, particularly for commercial customers. The two-tier system is divided into peak hours and off-peak hours. Off-peak hours occur when electrical demand is the lowest, and peak hours occur when electrical demand is the highest. Off-peak hours generally occur late at night and early in the morning, while peak hours generally occur late in the morning and in the afternoon. The price of electricity is much higher during the peak hours of the day than during off peak hours. The ratio between peak and off peak prices often varies from 2:1 to 4:1. Furthermore, demand charges are quite often not levied during off-peak hours.

For many businesses, such as office buildings and restaurants, electrical energy usage, particularly for air conditioning, is a major portion of its operating costs. Therefore, in connection with air conditioning, it is advantageous to utilize high electrical use devices such as compressors only during off-peak times and to utilize stored energy during the peak times.

Various proposals have been suggested for accomplishing the above, some of which are set forth in *The Complete Guide To Energy Storage For Cooling Commercial Buildings,* published by McCannon Consulting Group of San Diego, Calif., in July of 1985.

Currently, there are two basic types of cold storage systems available. One type utilizes a large tank for storing chilled water. Compressors are utilized to chill the water down to about 40° F. during off-peak hours. The chilled water is then circulated into the space to be conditioned in the building by means of a pump during peak hours. One major disadvantage of the chilled water system is that it requires a very large water storage tank to accomplish a substantial amount of cooling in most commercial buildings.

Other types of cool storage systems currently available are ice storage systems. Generally, the two types of ice storage systems are a static or ice building system and a dynamic or an ice shucking system. In a static system, a storage tank is built around cooling coils, whereby ice is formed around the coils. The water remaining in the tank is circulated into the building during peak demand hours and the ice on the coils melts as heat exchange occurs from the outside of the ice formation towards the cooling coils. One disadvantage of this coil system is that as ice builds on the outside of the coils, the ice itself creates an insulating effect progressively causing the use of more energy when the next ice-forming cycle occurs.

In the ice-shucking system, ice is made in sheet or crushed form and delivered for storage into large bins similar to those used in the water chilled system. While ice systems have advantages over the water chilled systems, particularly in that a smaller storage volume is required, colder temperatures are needed, resulting in the use of larger compressors and larger condensing units and more energy is spent per ton of ice produced.

Other types of ice storage systems have been recently developed. One type utilizes a glycol solution circulating through the coils in the tank. This system freezes substantially all the water in the tank. Some of the disadvantages of the glycol system are the added heat exchanger required to cool the glycol by refrigeration and a lower evaporator temperature which results in greater energy required to produce a given amount of cooling.

OBJECTS OF THE INVENTION

It is therefore one object of this invention to provide an improved energy storage system.

It is another object to provide an improved ice or eutectic storage refrigeration system.

It is another object to provide a system for storing energy during off-peak electrical demand time for discharging the energy during peak demand.

It is still another object to provide a cost efficient air conditioning system.

SUMMARY OF THE INVENTION

In accordance with one form of this invention, there is provided a system for providing conditioned air in a predetermined space. The system includes an insulated tank for receiving materials which exist in solid and liquid phases and which contain substantial latent heat. A plurality of coils are received in the tank. The coils contain a refrigerant. A condensing unit is connected to the coils for supplying liquid refrigerant to the coils which upon expansion freeze or solidify the material in the tank during a first time period which preferably corresponds to off-peak electrical demand. The coils are also connected to an evaporating unit which receives cold refrigerant liquid from the coils during a second time period which preferably corresponds to peak electrical demand. The condensing unit may also be directly connected to the evaporator unit bypassing the coils in the tank for providing refrigerant to the evaporator unit during a third time period.

In accordance with another form of this invention, the above tank itself is provided. The tank is insulated on its top, bottom and side walls. The coils are on closely spaced centers, causing the phase changed materials to freeze substantially completely solid within the tank at least in the vicinity of the coils during one time period and to thaw during another time period. During the thaw period, non-frozen annular spaces are formed about the coils. During the next freeze cycle for the tank, the non-frozen annular spaces provide an advantage over the systems which leave frozen material around the coils. Namely, it is much easier to freeze the liquid in direct contact with the coils rather than through the frozen material. Preferably, air is injected into the liquid annular spaces to agitate the liquid, thus enhancing the heat transfer between the frozen materials and the coils during the thaw period.

A pump may be provided to discharge the cold liquid from the coils to the evaporating unit during the second time period with the condensing unit being turned off, thereby saving substantial energy. Preferably, an accumulator is provided within the tank to receive the evaporated refrigerant vapor and for recycling the vaporized refrigerant back through the coils where it is recondensed.

BRIEF DESCRIPTION OF THE DRAWINGS

The subject matter which is regarded as the invention is set forth in the appended claims. The invention itself, however, together with further objects and advantages thereof may be better seen in reference to the following description taken into conjunction with accompanying drawing, in which:

DESCRIPTION OF THE PREFERRED EMBODIMENTS

Figure 1:
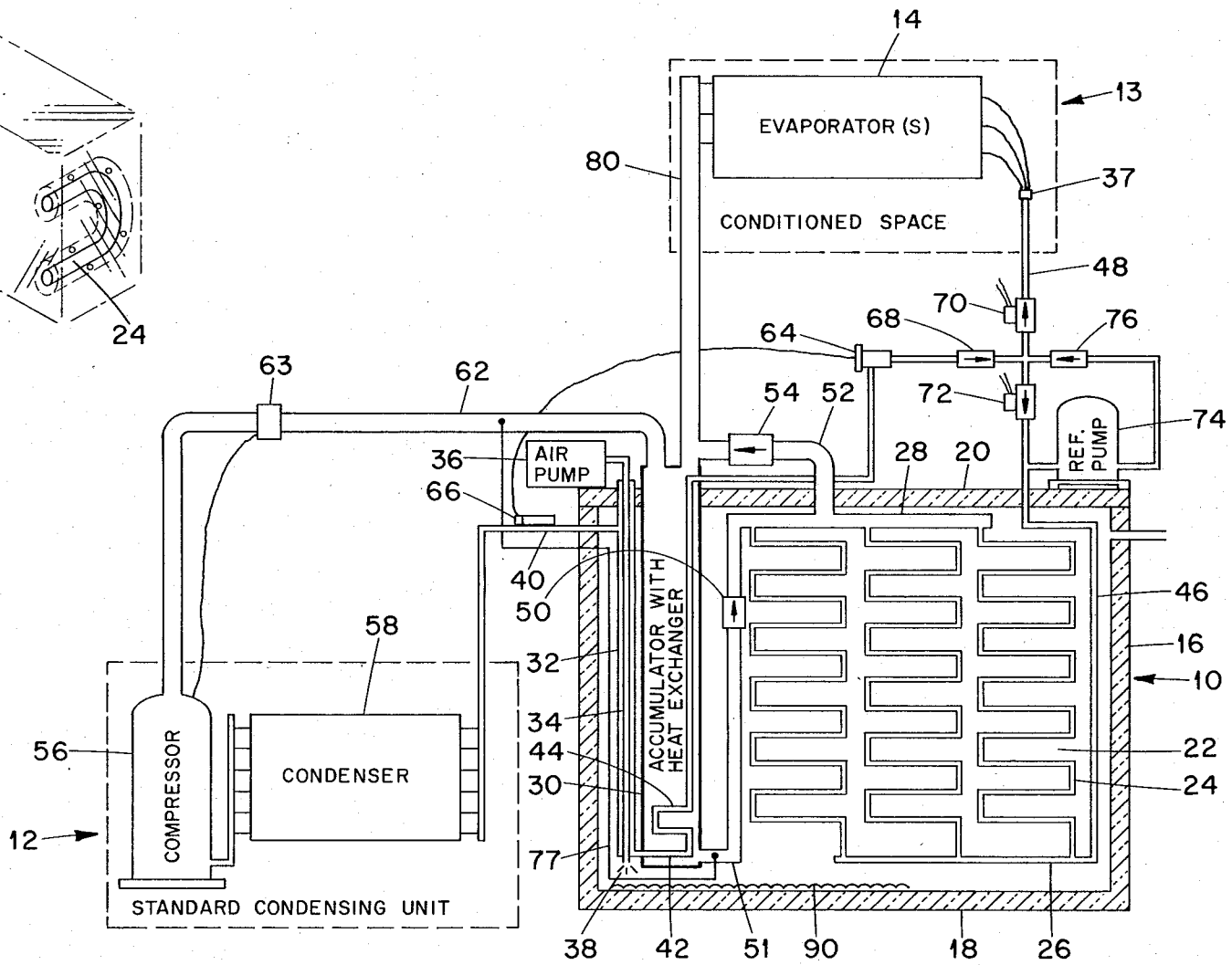
FIG. 1 is a schematic diagram of the system and tank of the subject invention with the tank shown in cross section.

Referring now more particularly to FIG. 1, there is provided insulated tank 10 which is connected to condensing unit 12 and evaporating unit 14 for providing air conditioning, which is the preferred use of the invention. Tank 10 is preferably cylindrical in shape; therefore, insulated side walls 16 are normally curved. The tank includes insulated bottom 18 and insulated lid 20.

The tank is filled with a material 22 which can exist in both liquid and solid phases and which has a high latent heat of fusion. The preferred type of material is water which has a latent heat infusion of 144 BTUs per pound, resulting in the storage of large amounts of energy when the water is turned to ice. Other types of materials which may be stored in the tank are eutectic salts which absorb and release heat at temperatures lower than 32° F. Each eutectic salt composition has a constant freezing point that depends on its composition. Various salts may be used so long as the phase change temperatures are within an acceptable range for cooling temperature requirements. Phase change temperature from 32° F. to −20° F. are accepted.

Tank 10 includes a plurality of coils 24 located throughout the entire tank. The coils are preferably made of hollow copper tubing, and are on closely spaced centers with adjacent tubes being preferably no more than 1.5 inches apart, but in some cases up to 2 inches. Greater spacing is possible; however, it becomes more difficult to freeze the water solid in the tank. The bottoms of the coils 24 are connected together by manifold 26, while the tops are connected together by manifold 28. The tank further includes a hollow accumulator tube 30, which is elongated and received vertically within the tank 10 with a portion extending out from the lid 20. A pair of concentric tubes 32 and 34 are also received within tank 10 and are oriented adjacent to accumulator 30. Tube 34, which is the inner tube, is adapted to be connected to air pump 36, which may be attached to the lid of the tank. Tube 34 is opened on its end 38, where it extends out of tube 32 into the tank. Tube 40 is connected to tube 32, which in turn is connected to a condensing unit, the function of which will be explained below. The other end of tube 32 is connected to tube 42, which is received inside of accumulator tube 30. Tube 42 includes coiled section 44 to provide a heat exchange with the materials in the tube and materials in accumulator 30. Tube 42 is adapted to be selectively connected to either tube 46, which in turn is connected to manifold 26 of coils 24, or to tube 48, which is connected to evaporating unit 14. The bottom of accumulator 30 is connected to manifold 28 through one way check valve 50. The top of the accumulator 30 is also connected to manifold 28 by tube 52 through one-way check valve 54 or a solenoid valve (not shown).

The above described tank is useful as an energy storage unit particularly for making ice during off-peak electrical hours and storing ice for discharge of the energy during peak hours. The tank may be utilized with several systems, including an air conditioning system described below, which is the preferred embodiment. It also may be utilized with a system for diverting the latent heat of fusion into ambient air or to a space to be heated while ice is being made. Also, it may be utilized to do load leveling for reducing the size of the compressor needed. The preferred embodiment, which is an air conditioning system, is described below.

Referring again to FIG. 1, a standard commercially available condensing unit 12 is provided, including compressor 56 which is connected to condensor 58. The condensor is connected to tube 40, which passes into insulated tank 10 through wall 16. The compressor is connected to the top of the accumulator 30 by means of tube 62 which serves as a return for refrigerant vapor to the compressor. Pressure sensor 63 is connected to tube 62 for sensing refrigerant vapor pressure and controlling compressor 56. The preferred refrigerant material which is utilized with the compressor 56 and which is contained in coils 24 and all of the tubes referred to herein except for air line 34 may be a standard air conditioning refrigerant such as Freon-22, which exists both in a liquid and vapor states.

Tube 42 is connected to valve 64 which is opened in response to temperature sensor 66, which is attached to tube 40, indicating that the liquid Freon-22 is subcooled 4° F. below its condensing temperature as sensed on tube 40. Valve 64 is further connected to one-way check valve 68. Check valve 68 is connected to both tube 48 through solenoid operated valve 70 and to tube 46 through solenoid operated valve 72. Check valve 68 will not permit refrigerant to flow from the junction of the solenoid operated valves to valve 64. Solenoid operated valves 70 and 72 are opened and closed in accordance with Table I which follows.

Tube 46 is connected to tube 48 through pump 74 and valve 70, thus bypassing valve 72. The connection from line 46 to line 48 occurs as set forth in Table I which follows. Pump 74 is connected to line 48 through one-way check valve 76.

The compressor oil is returned by oil return line 77, which is connected between tube 51 and tube 62.

TABLE I

| | MODE | | | |
|---|---|---|---|---|
| COMPONENT | ICE MAKING | ON-PEAK COOLING | OFF-PEAK COOLING | STAND BY |
| Cond. Unit 12 | On | Off | On | Off |
| Refrigerant Pump 74 | Off | On | On | Off |
| Solenoid 72 | Open | Closed | Closed | Closed |
| Solenoid 70 | Closed | Open | Open | Closed |
| Air Pump 36 | On | On | Off | Off |
| Indoor Blower in Space 13 | Off | On | On | Off |
| Timer Contacts | Closed | Open | Closed | Open/ Closed |
| Thermostat Contacts in Space 13 | Open | Closed | Closed | Open |
| Pressure Sensor Contacts 63 | Closed | Closed | Closed | Open |

Reference is made to Table I, wherein the ice making mode of operation is allowed when timer contacts (not shown) are closed and will continue until the timer contacts open or the pressure sensor contacts 63 open or until the room thermostat contacts (not shown) close, which will change the mode into off-peak cooling. The timer simply is set to correspond with the on-peak and off-peak times of the applicable electric utility. The percentage of time that off-peak cooling will be required is small, since ice is built at night and during early morning hours, which are cool compared to afternoon hours. The pressure sensor contacts 63 will open only when the ice tank is fully frozen or nearly so. During the ice making mode, ice will be made inside of tank 10. Compressor 56 will come on, forcing pressurized hot refrigerant into condenser 58. Condenser 58 will release the refrigerant, and it will expand into tube 60 through tube 40 down tube 32 within tank 10 through tube 42, which is contained in accumulator 30. Valve 64 will be meter liquid refrigerant in response to subcooling, indicated by indicator 66. The refrigerant will flow through check valve 68 and through open valve 72 into tube 46. The refrigerant will further flow into manifold 26 and expand into the plurality of coils 24, resulting in a large drop in temperature on the coils. Water 22 will begin freezing around the annular surfaces of the coils until substantially all of the water within the tank, at least in the vicinity of the coils, is frozen solid. This solid freezing is indicated by the lowering of the evaporator pressure below a set value which causes the pressure detector 63 to shut down the compressor 56. With the ice frozen solid and with compressor 56 shut off, the system will remain in stand-by until air conditioning is called for within conditioned space 13 by the thermostat (not shown) located therein. When air conditioning is called for as indicated by the thermostat, during peak demand hours, refrigerant pump 74 comes on, as well as air pump 62. Pump 74 will move the cold refrigerant out of the coils 24 through tube 48 through check valve 76 and into tube 48 through open solenoid 70 and then into evaporator unit 14, which is a standard commercially available evaporator unit. The liquid refrigerant is substantially changed from cold liquid to vapor within evaporator 14, resulting in cooling or air conditioning space 13. The vapor from evaporator unit 14, as well as any remaining liquid, is transferred from the evaporator unit 14 through tube 80 to accumulator 30. Since the condensing unit is not operating during peak hours, refrigerant vapor and liquid will flow back into tube 51 from the bottom of the accumulator and into manifold 28 through check valve 50. The warmed refrigerant which is received from the evaporator is cooled and condensed by the ice as it moves again through the plurality of coils 24 and the cycle begins again.

Figure 2:
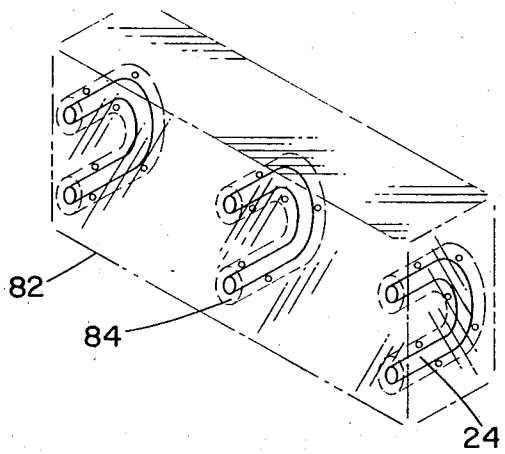
FIG. 2 is a partial perspective view showing some of the coils in the tank of FIG. 1 embedded in ice.

During this discharge cycle, the ice in tank 10 begins to melt. This may be better seen in reference to FIG. 2, which shows a perspective view of portion of coils 24 in ice 82. As the ice begins to melt because of the heat exchange between the coils and the ice, liquid annular spaces 84 are formed concentrically around each of the coils. With the water being in direct contact with the coils, it is much easier to freeze the water during the next freeze cycle than the prior art system, where the ice remains in contact with the coils.

Furthermore, air pump 36 provides air to the bottom of the tank through opening 38; thus, air bubbles are received in the annular spaces 84, causing water turbulence within the annular spaces, increasing the heat transfer between the ice and coils because of convection as well as conduction. A heating wire 90 may be used to open the bottom of the tank if it is frozen so that the air may get to the annular space.

Since air conditioning is also required during off-peak hours, the off-peak cooling is shown in Table I.

In this mode, the air conditioning essentially bypasses the ice storage tank and little ice is melted. The refrigerant pump 74 is operated to drain liquid refrigerant from the ice coils 24 and the accumulator 30 and put into the mainstream of refrigerant flow. It has been found that the total charge in one size system was reduced from 40 pounds of Freon 22 to 12 pounds by operating the refrigerant pump in the off-peak cooling mode. To reduce the amount of ice melted during off-peak cooling mode, the air pump 36 does not operate.

Upon opening of the room thermostat contacts when operating in the off-peak cooling mode, the system reverts to the ice making mode to restore the small amount of ice melted in the off-peak cooling mode.

The main flow of refrigerant is from condensing unit 12 through tube 42 through cooling valve 64 through check valve 68 and through open solenoid 70, while solenoid 72 is closed and onto evaporator unit 14. The condensing unit could also supply the evaporators directly during on-peak cooling if the ice in tank 10 has been completely used up or the temperature in the tank had come up to a point where it was no longer useful as a cooling device.

There are several systems besides the one described above that can utilize the novel ice storage tank 10 that are readily understood by those skilled in the art. For example:

(1) By reducing the size of the consensing unit and allowing it to operate at any time that cooling is called for and also to build ice when the room thermostat is satisfied, a load leveling system can be provided. The reduced peak demand and the reduced cost of the condensing unit provide the compensation for the system.

(2) By diverting the heat output of the condensing unit to heat the building space during cool nights, the morning warmup demands can be reduced at little extra cost.

(3) Most condensing units cannot serve multiple evaporators in conventional systems. The use of multiple evaporators with the ice storage system makes it attractive in many buildings with independently controlled zones of cooling.

From the foregoing description of the preferred embodiments of the invention, it will be apparent that many modifications may be made therein without departing from the true spirit and scope of the invention.

I claim:

1. An energy storage system comprising:

an insulated top, bottom and side walls forming a container for housing a material which has liquid and solid phases and has a substantial latent heat fusion.

a plurality of hollow coils which are received in said container; said coils containing a refrigerant fluid; said fluid existing at either a liquid or vapor state depending on its temperature and pressure for alternatively liquifying and solidifying said material;

said material being substantially completely solidified in the vicinity of said coils during one time period and having a liquid annular portion about said coils during another time period;

means for connecting said coils to a space to be conditioned; an accumulator disposed within said container; means for connecting said accumulator to said coils.

2. A system as set forth in claim 1, wherein said material is water.

3. A system as set forth in claim 1, further including a fluid pump connected to said coils and adapted to move fluid to a space to be conditioned.

4. A system as set forth in claim 1, further including means for agitating said material in said container, said means for agitating connected to said container for increasing heat transfer in said liquid annular portion between said material in its solid phase and said coils.

5. A system as set forth in claim 1 wherein adjacent coils are spread no more than two inches apart.

6. A system for providing air conditioning during both peak and off-peak electrical utility time intervals comprising:

an insulated tank for receiving material which exists in solid and liquid phases; said material having substantial latent heat of fusion;

a plurality of coils received in said tank; said coils containing a fluid which exists at liquid and vapor states;

a condensing unit; said coils connected to said condensing unit; said condensing unit supplying fluid to said coils whereby the liquid in said tank in the vicinity of said coils is substantially converted to its solid phase during a first predetermined time period;

an evaporating unit located in a space to be conditioned;

means for connecting said evaporating unit to said coils; said evaporator unit receiving cold fluid from said coils during a second predetermined time period.

an accumulator received in said tank and connected to said coils.

7. A system as set forth in claim 6, wherein said condensing unit is also connected to said evaporating unit; said evaporating unit receiving fluid from said condensing unit during a third predeterminded time period.

8. A system as set forth in claim 6, further including a fluid pump connected between said coils and said evaporating unit.

9. A system as set forth in claim 6, further including an air pump connected to said material in said tank for agitating the liquid phase of said material, thus improving the heat transfer between said coils and the solid phase of said material.

* * * * *